US008904933B2

(12) United States Patent
Nudo et al.

(10) Patent No.: US 8,904,933 B2
(45) Date of Patent: Dec. 9, 2014

(54) IGNITER AND METHOD OF MAKING

(75) Inventors: Nicholas Nudo, The Woodlands, TX (US); Edward Dobies, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 274 days.

(21) Appl. No.: 13/435,521

(22) Filed: Mar. 30, 2012

(65) Prior Publication Data

US 2013/0255522 A1 Oct. 3, 2013

(51) Int. Cl.
*F42B 3/12* (2006.01)

(52) U.S. Cl.
USPC ..... 102/202.9; 102/202.5

(58) Field of Classification Search
USPC ..... 102/202.5, 202.9, 202.11, 202.12, 102/202.14, 205
See application file for complete search history.

(56) References Cited

U.S. PATENT DOCUMENTS 4,306,499 A * 12/1981 Holmes ..... 102/202.4

OTHER PUBLICATIONS

Woods, Joe, "Crimp or Solder?", Import Service, Dec. 1999 Issue, 6 pages.

* cited by examiner

*Primary Examiner* — Daniel J Troy
(74) *Attorney, Agent, or Firm* — Cantor Colburn LLP

(57) ABSTRACT

An igniter includes, a sleeve receptive to combustible medium, a resistor in operable communication with the combustible medium, and at least one lead in electrical communication with the resistor and the sleeve the electrical communication with the sleeve is maintained by interference fit between the sleeve and the at least one lead.

12 Claims, 2 Drawing Sheets

IGNITER AND METHOD OF MAKING

BACKGROUND

Electrical igniters, such as those employed in downhole applications in the hydrocarbon recover and carbon dioxide sequestration industries, for example, must remain operational after being positioned in harsh environments. Among other things this operational integrity is dependent upon maintenance of all electrical connections in the circuit that supplies current to the resistor. Although electrical connections employed in igniters serve the function for which they were designed, industries that employ such igniters are always receptive to new devices and methods of assembly that may enhance reliability of the igniters.

BRIEF DESCRIPTION

Disclosed herein is an igniter. The igniter includes, a sleeve receptive to combustible medium, a resistor in operable communication with the combustible medium, and at least one lead in electrical communication with the resistor and the sleeve and the electrical communication with the sleeve is maintained by interference fit between the sleeve and the at least one lead.

Further disclosed herein is a method of making an igniter. The method includes, interferingly electrically engaging a first lead of a resistor to a conductor, attaching the conductor to a head, encasing the resistor within a sleeve, attaching the sleeve to the head, and interferingly electrically engaging a second lead of the resistor to the sleeve.

Further disclosed herein is an igniter. The igniter includes, a sleeve receptive to combustible medium, a resistor in operable communication with the combustible medium, at least one lead in electrical communication with the resistor, and a conductor in electrical communication with the at least one lead, and the electrical communication between the conductor and the at least one lead is maintained by interference fit between the conductor and the at least one lead.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
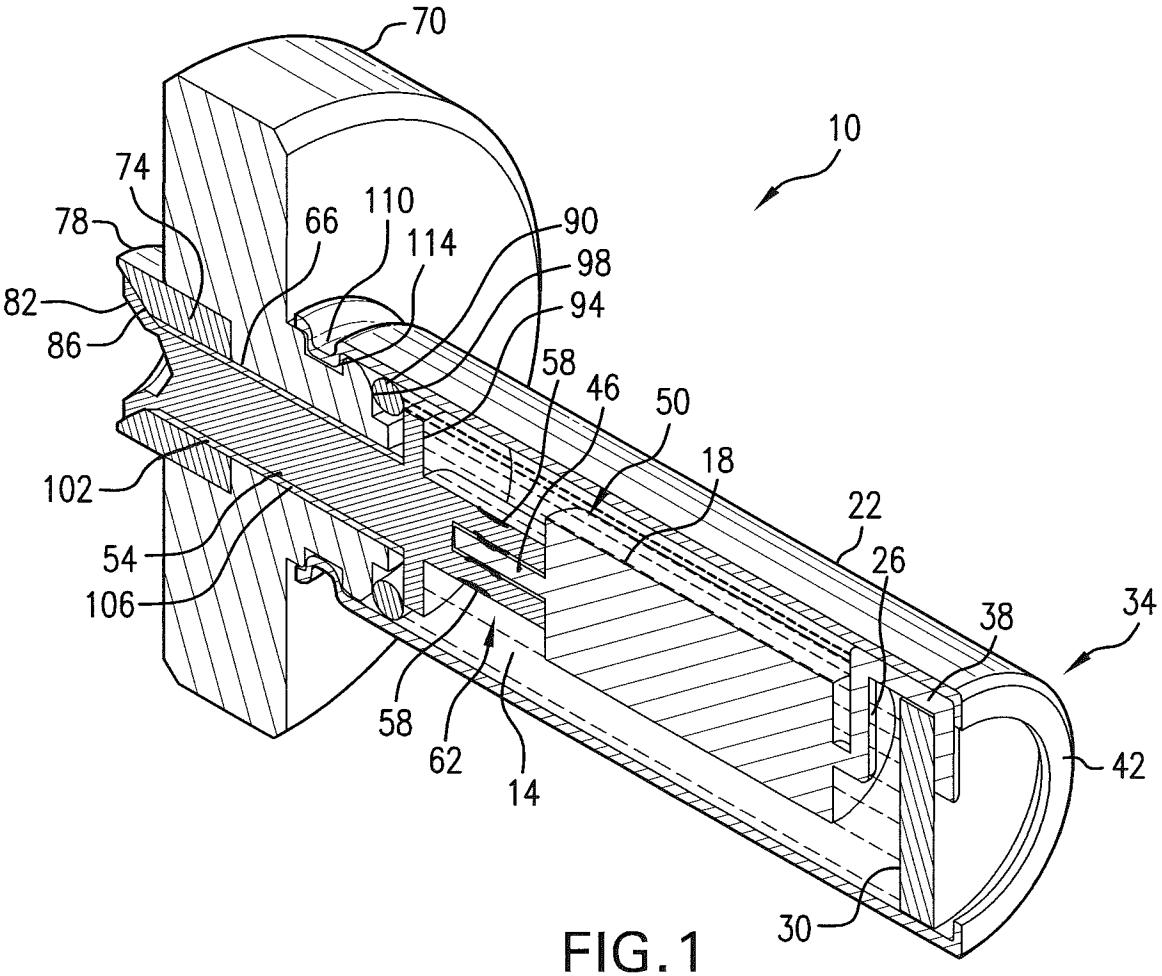
FIG. 1 depicts a cross sectional perspective view of an igniter disclosed herein.
Figure 2:
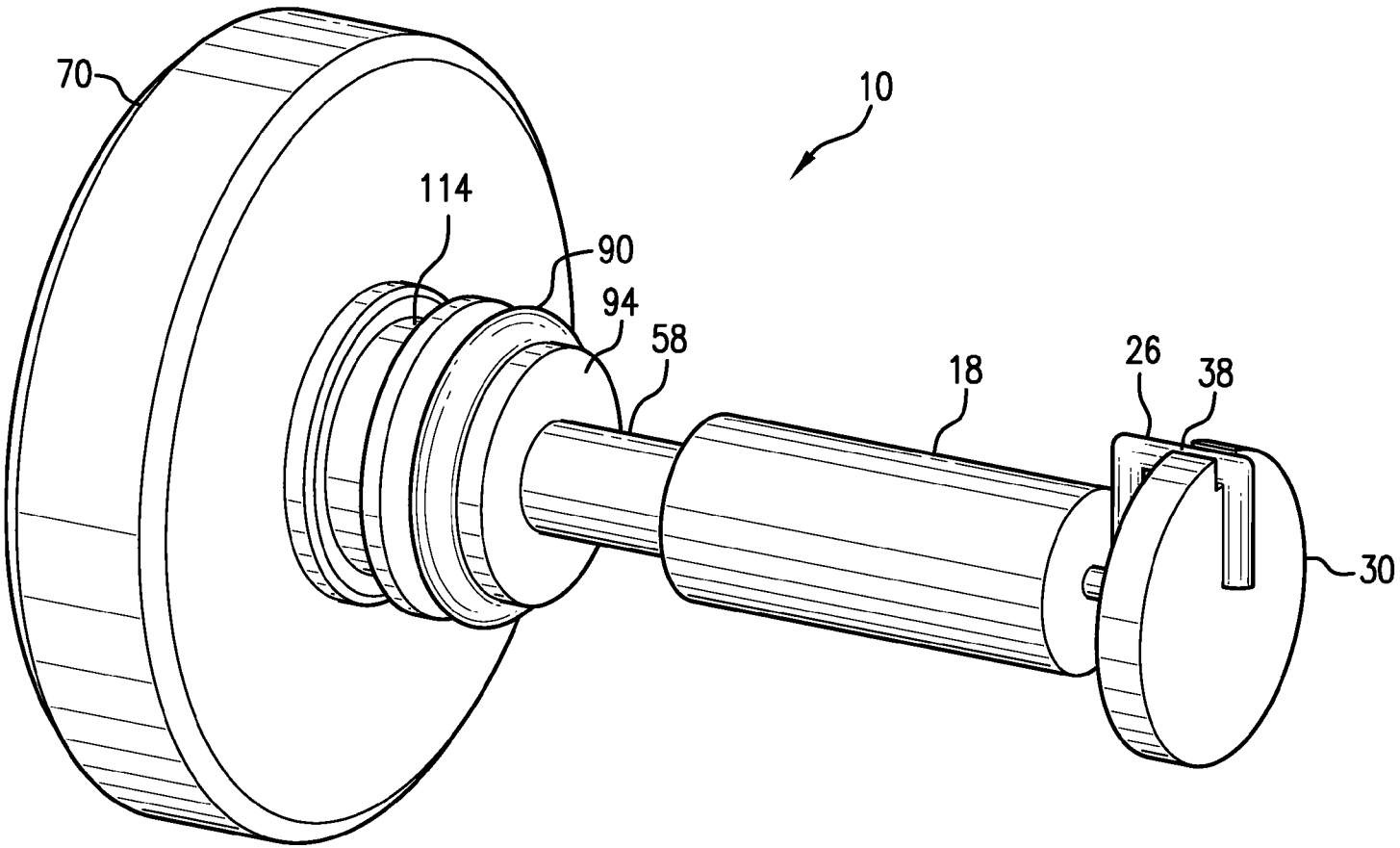
FIG. 2 depicts a perspective view of the igniter of FIG. 1 with the sleeve removed.

Referring to FIGS. 1 and 2, an igniter disclosed herein is illustrated at 10. The igniter 10 includes, combustible medium 14, and a resistor 18 encased within a sleeve 22. The resistor 18 has a lead 26 extending therefrom that is electrically connected to the sleeve 22 by an interference fit. The interference fit is accomplished by crimping the sleeve 22 relative to a plate 30, illustrated herein as an end disc, positioned within an end 34 of the sleeve 22. The lead 26 is bent and positioned within a slot 38 in the end plate 30 prior to the sleeve 22 being positioned therearound. The slot 38 can be sized to assure that the sleeve 22 makes contact with the lead

26 when positioned therearound, thereby generating the interference fit between the lead 26 and the sleeve 22 during the assembly process. Alternately, the interference fit can be established or generated by crimping of the sleeve 22 relative to the lead 26 and the end plate 30. A lip 42 on the end 34 (either preformed in the sleeve 22 or formed during or independent of the crimping operation) prevents the end plate 30 from dislodging from the end 34 at least until ignition of the medium 14. The interference fit between the lead 26 and the sleeve 22 provides electrical connectivity therebetween so that current can pass between the lead 26 and the sleeve 22. Currents of sufficient value cause initiation of the ignition process by heating the resistor 18 and igniting the combustible medium 14. Additionally, the plate is sealingly engaged with the lead 26 and the sleeve 22 to prevent the combustible medium 14 from escaping therebetween.

In this embodiment, the resistor 18 has a second lead 46 that extends from an opposing end 50 of the resistor 18 than the first lead 26. The second lead 46 is in electrical communication with a conductor 54, illustrated in this embodiment as a rivet, via an interference fit between the rivet 54 and the second lead 46. The interference fit in this embodiment is generated by crimping walls 58 of a tubular portion 62 of the rivet 54 against the second lead 46.

The rivet 54 extends through a bore 66 in an igniter head 70 and through a bore 74 in an insulator 78. A tubular end 82 of the rivet 54 is radially flared into engagement with a surface 86 of the insulator to longitudinally retain the rivet 54 relative to the igniter head 70 and the insulator 78. A spacer 90, illustrated herein as a seal, is compressed longitudinally between a flange 94 of the rivet 54 and a surface 98 of the igniter head 70. The spacer 90 facilitates alignment and serves as a barrier to direct the combustible medium 14 toward the intended path through the plate 30. An insulator tube 102 electrically insulates a radial surface 106 of the rivet 54 from the igniter head 70 and may be shrunk fit over the radial surface 106 to improve fit and assist the assembly process.

In this embodiment, the sleeve 22 after having been positioned around the resistor 18 is attached to the igniter head 70 with an interference fit. The interference fit is generated by crimping the sleeve 22 radially inwardly so that a portion 110 of the sleeve 22 deforms into a radial groove 114 formed in the igniter head 70. Alternately, the interference fit could be due to the fit between the sleeve 22 and the igniter head 70 such that the simple longitudinal engagement of the sleeve 22 about the igniter head 70 generates the desired interference fit. Regardless of how the interference fit between the sleeve 22 and the igniter head 70 is established, it should be sufficient to create good electrical continuity between the sleeve 22 and the igniter head 70.

Although three separate interference fits have been disclosed herein, it should be understood that embodiments of the invention, though not specifically illustrated, can include any combination of one or more of these three separate interference fits.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An igniter comprising:

a sleeve receptive to combustible medium;

a resistor in operable communication with the combustible medium;

a first lead in electrical communication with the resistor and the sleeve the electrical communication with the sleeve being maintained by a first interference fit between the sleeve and the first lead;

a conductor being in electrical communication with the resistor and a second lead, the electrical communication with the conductor and the second lead being by a second interference fit between the conductor and the second lead; and a head in operable communication with the conductor, the conductor being structurally retained to the head via a flaring of a portion of the conductor, the flaring portion being in electrical communication with the conductor.

2. The igniter of claim 1, wherein the first interference fit includes a crimp.

3. The igniter of claim 1, further comprising a plate maintained in contact with the first lead and the sleeve by the first interference fit.

4. The igniter of claim 3, wherein the plate includes a slot receptive to the first lead.

5. The igniter of claim 3, wherein the plate is a disc.

6. The igniter of claim 3, wherein the plate seals to at least one of the sleeve and the first lead to prevent the combustible medium from escaping therebetween.

7. The igniter of claim 1, wherein the portion of the conductor that is flared has a tubular shape prior to being flared.

8. The igniter of claim 1, wherein the second interference fit between the conductor and the second lead is a crimp between the conductor and the second lead.

9. The igniter of claim 1, wherein the portion of the conductor that is flared has a frustoconical shape after being flared.

10. The igniter of claim 1, wherein the conductor and the head are electrically isolated from one another.

11. The igniter of claim 1, wherein the head is structurally attached to the sleeve by a third interference fit.

12. The igniter of claim 11, wherein the third interference fit between the head and the sleeve is via a crimp between the sleeve and the head.

* * * * *